US007621466B2

(12) United States Patent
Ko et al.

(10) Patent No.: US 7,621,466 B2
(45) Date of Patent: Nov. 24, 2009

(54) NOZZLE FOR COLD SPRAY AND COLD SPRAY APPARATUS USING SAME

(75) Inventors: Kyung-hyun Ko, Suwon (KR); Ha-yong Lee, Suwon (KR); Jea-hong Lee, Pyungtaek (KR); Jae-jeong Lee, Pyungtaek (KR); Young-ho Yu, Pyungtaek (KR)

(73) Assignee: SNT Co., Ltd. (KR)

( * ) Notice: Subject to any disclaimer, the term of this patent is extended or adjusted under 35 U.S.C. 154(b) by 731 days.

(21) Appl. No.: 11/188,029

(22) Filed: Jul. 22, 2005

(65) Prior Publication Data

US 2006/0201418 A1 Sep. 14, 2006

(30) Foreign Application Priority Data

Mar. 9, 2005 (KR) ..... 10-2005-0019727
Mar. 9, 2005 (KR) ..... 10-2005-0019732

(51) Int. Cl.
*B05B 7/04* (2006.01)
*B05B 1/04* (2006.01)

(52) U.S. Cl. ..... 239/434.5; 239/398; 239/423; 239/594

(58) Field of Classification Search ..... 239/79, 239/85, 290, 300, 398, 416.5, 418, 423, 434.5, 239/592, 594, 597; 427/180, 189–192, 446, 427/455, 456; 118/300, 308
See application file for complete search history.

(56) References Cited

U.S. PATENT DOCUMENTS 6,139,913 A 10/2000 Van Steenkiste et al.
6,722,584 B2 * 4/2004 Kay et al. ..... 451/439
2005/0040260 A1 * 2/2005 Zhao et al. ..... 239/548

* cited by examiner

*Primary Examiner*—Darren W Gorman
(74) *Attorney, Agent, or Firm*—Cantor Colburn LLP

(57) ABSTRACT

Disclosed is a nozzle for cold spray and a cold spray apparatus using the same. The nozzle for cold spray includes a hollow-type nozzle section. The nozzle section includes a convergence inlet section in which the cross-sectional area is converging, a throat area connected to the convergence end point of the inlet section, and an outlet section connected to the end point of the throat area. The nozzle for cold spray is provided with a spray tube located inside the convergence inlet section, the spray tube having a spray hole formed at its end point in such a way as to be placed at the throat area or the outlet section beyond the throat area. The speed of the powder flow at the outlet end point of the outlet section reaches 300-1,200 m/s.

6 Claims, 11 Drawing Sheets

NOZZLE FOR COLD SPRAY AND COLD SPRAY APPARATUS USING SAME

BACKGROUND OF THE INVENTION

1. Field of the Invention

The present invention relates to a nozzle for cold spray and a cold spray apparatus using the same. More specifically, the invention relates to such a nozzle for cold spray and a cold spray apparatus using the same, which can minimize clogging phenomenon of a nozzle generated because the inside of the nozzle is coated with powder of soft material when coating with the powder, and prevent abrasion of the nozzle caused by collision of powder of very hard material against the nozzle wall is prevented when coating with powder, thereby making it easy to apply to mass production since the nozzle can be used for a long time, reducing manufacturing costs in mass production by enabling high quality coating for a long period of time, enabling low cost construction of facilities since the powder supplying device needs not a high pressurizing device, and facilitating modifications of processes by adjusting the location of the spray tube to control the speed of powder without controlling the flow rate of gas supply.

2. Background of the Related Art

A cold spray coating refers to a method of coating the surface of an object to be coated by spraying powder at normal or relatively low unheated temperature using supersonic carrier gas, in which small particles (1-50 μm) accelerated by supersonic jet air currents (300-1,200 m/s) are collided and coated on metallic or ceramic boards, and the temperature and the speed of the accelerated gas and the size of the particles are applied as variables of the coating process.

Specifically, such a cold spray coating method is based on the principle that highly accelerated particles collide into unheated boards for coating, so that the coating efficiency differs according to the materials to be coated. The coating efficiency also increases as the speed of the accelerated particles increases. That is, the coating efficiency shows a characteristic of abrupt increase above a certain speed.

Basic requirements for coating by a cold spray coating method using supersonic speed are as follows: A) The temperature of jet air currents must always be lower than the melting point or the softening point of the accelerated particles. B) The size of the accelerated particles must be within a range between 1 and 50 μm. C) The speed of the particles must be within a range between 300 and 1,200 m/s according to the material and the size of particles. In reality, particles are coated with the help of supersonic jet air currents of Mach 2-4 and 1-3 MPa, and, for the type of gas, a gas such as air, nitrogen and helium or a gas mixture that comprises of air, nitrogen, and helium is used. Whatever gas may be used, coating is possible only when the speed of accelerated particles exceed the critical speed ($V<V_{crit}$).

For this reason, the temperature of gas is raised to increase the speed of gas to so as to increase the amount of gas, and a typical De Laval type nozzle as a publicized technology is used to provide supersonic carrier gas. The technology is disclosed in U.S. Pat. No. 6,139,913 which has the configuration depicted in FIG. 8. However, as shown in FIG. 8, before the throat area, the De Laval type nozzle (a convergence-divergence nozzle) mixes the carrier gas provided from the lower part with a gas/powder mixture which is a mixture of gas and powder provided from the left side before a throat area, and then accelerates the resultant mixture.

Accordingly, as shown in FIGS. 9 and 10, the gas/powder mixture provided like this is accelerated gradually through the convergence section of the convergence-divergence nozzle, reaching the speed of sound at the throat area. In this case, the latter part of the nozzle is configured as a divergence type to maintain evenly the mass of the gas passing a specific point after the gas/powder arrive the speed of sound. Like this, the speed of gas which passed the throat area increases to become supersonic speed in the end. The gas flowing at supersonic speed has such a characteristic that the speed expanding outward is faster than the speed accelerated in the backward, since the gas transfers energy in the direction of circumference when compressed toward the axial direction. Using this principle, a convergence-divergence nozzle makes a thrust which is needed to project the gas/powder mixture in the nozzle at a supersonic speed.

However, in case of the method depicted in FIG. 8, since the gas/powder mixture flows in before the throat area, the powder undergoes a process of passing the throat area and being sprayed. In the case where the sprayed powder is comparatively soft like aluminum, the throat area is coated with powder, thus making the throat area clogged in a short time, so that the coating process cannot be performed any more. Consequently, the above method is hard to apply to mass production. In the case where the sprayed powder is very hard like nickel or super-alloy, the speed at the throat area is not more than speed of sound, and so coating is not accomplished, but the throat area is severely abraded due to the collision of the powder, thereby damaging the nozzle, and the modification of configuration of the throat area changes the flow speed, thus consequently altering the processing conditions.

In addition, in case of coating using the apparatus depicted in FIG. 8, the pressure applied to the spray tube which injects the gas/powder mixture provided from the left side of the nozzle must be higher than the pressure of the gas which is provided to the convergence part as carrier gas that is provided from the lower part of the nozzle, and so an additional pressurizing device has to be provided.

Furthermore, as shown in FIGS. 9 and 10, in case of using a publicized convergence-divergence nozzle, even though the location of the spray tube which provides the gas/powder mixture is changed, it can be observed that the final speed of the outlet flow at the outlet end point of the nozzle is not changed. Accordingly, in order to change the speed of the flow to modify process conditions, the amount of the flow of the entire system needs to be changed.

SUMMARY OF THE INVENTION

Therefore, the present invention has been made in view of the above problems occurring in the prior art, and it is an object of the present invention to provide a nozzle for cold spray and a cold spray apparatus using the same, in which clogging phenomenon of the nozzle is minimized when coating with powder of soft material, and abrasion of the nozzle is prevented when coating with powder of very hard material, thereby making it easy to apply to mass production since the nozzle can be used for a long time and enabling high quality coating for a long period of time.

In addition, another object of the invention is to provide a nozzle for cold spray and a cold spray apparatus using the same, in which the speed of powder that is sprayed from the outlet of the nozzle can be controlled without regulating the flow rate of supply gas, thereby facilitating control of processes.

Another object of the invention is to provide an economical nozzle for cold spray and a cold spray apparatus using the same, in which a coating apparatus can be configured at a low price since a separate pressurizing device is not installed at the gas/powder supply device, and can be used for a long time without maintenance and repair, thereby saving initial costs as well as operation costs.

To accomplish the above objects, according to the present invention, there is provided a nozzle for cold spray. The nozzle for cold spray includes: a hollow-type nozzle section including a convergence inlet section in which the cross-sectional area is converging, a throat area connected to the convergence end point of the inlet section, and an outlet section connected to the end point of the throat area; and a spray tube located inside the convergence inlet section, the spray tube having a spray hole formed at its end point in such a way as to be placed at the throat area or the outlet section beyond the throat area, wherein the speed of the powder flow at the outlet end point of the outlet section reaches 300-1,200 m/s.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Figure 1:
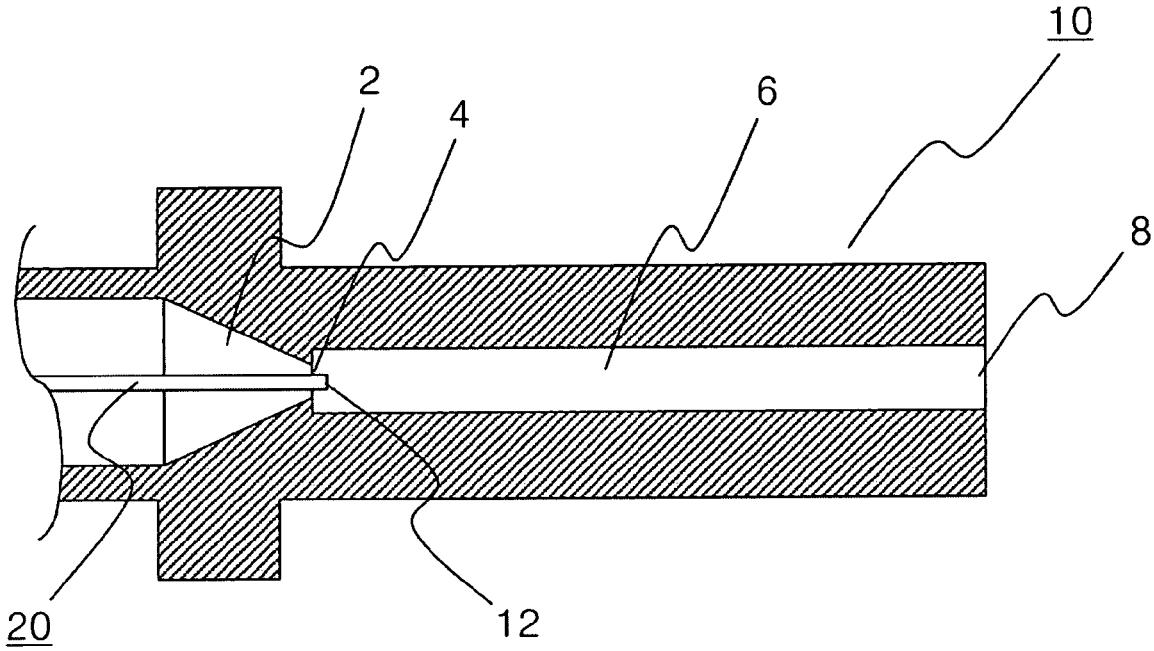
FIGS. 1 to 3 are cross-sectional views showing nozzles for cold spray of the embodiments of the invention.

The preferred embodiments of the invention will be hereafter described in detail, with reference to the accompanying drawings.

The present invention relates a nozzle for cold spray comprising: a hollow-type nozzle section 10 including a convergence inlet section 2 in which the cross-sectional area is converging, a throat area 4 connected to the convergence end point of the inlet section 2, and an outlet section 6 connected to the end point of the throat area 4; and a spray tube 20 located inside the convergence inlet section 2 and having a spray hole 12 formed at its end point in such a way as to be placed at the throat area 4 or the outlet section 6 beyond the throat area. The speed of the powder flow at the outlet end point 8 of the outlet section 6 reaches 300-1,200 m/s.

Figure 2:
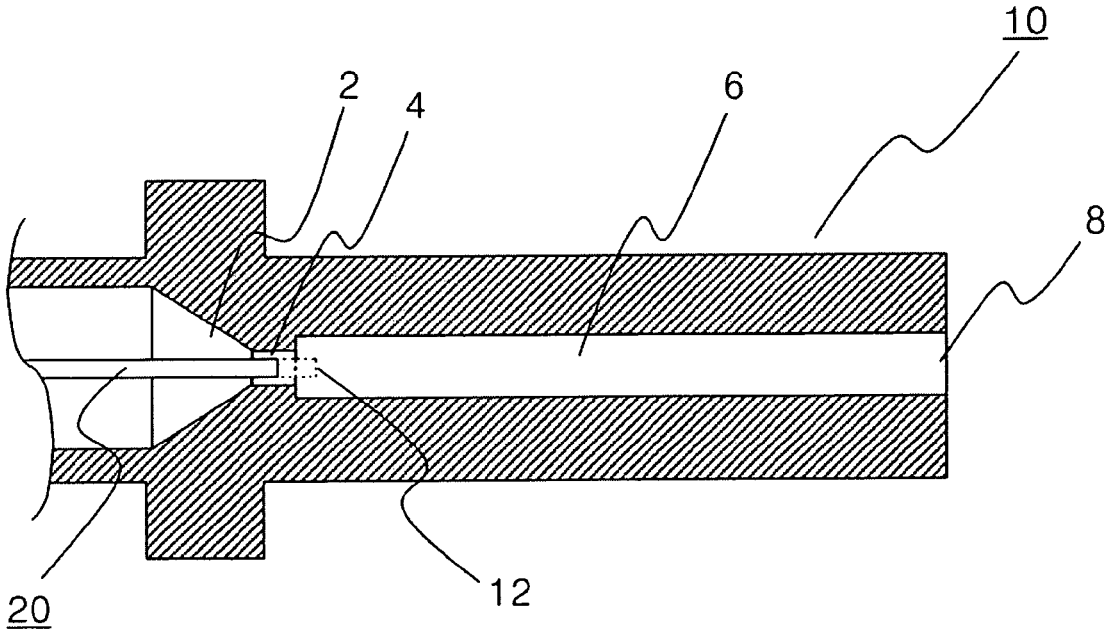
Figure 3:
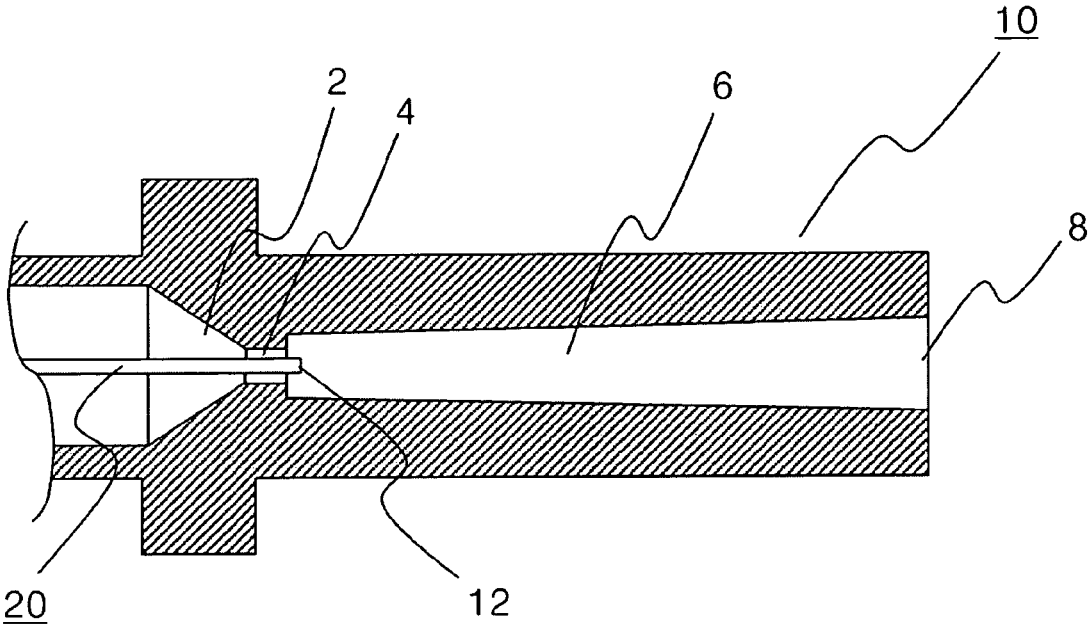

FIGS. 1 to 3 illustrate a detailed embodiment, in which the convergence inlet section 2 is so configured that the carrier gas reaches the speed of sound at the throat area 4, all the other part except the spray tube 20 being filled with only gas. Accordingly, the speed of the carrier gas at the throat area 4 comes up to the speed of sound, and the carrier gas passes the outlet section 6 where the flow is diverged (or expanded) and accelerated to 300-1,200 m/s. Together with the carrier gas, the gas/powder mixture supplied through the spray tube 20 is sprayed inside the throat area 4 or the outlet section 6 next to the throat area, therefore clogging due to coating or abrasion as a result of collision at the throat area 4 are not occurred. In addition, as the gas being sprayed in high speed areas, the pressure of the areas is lowered relatively, so the gas/powder mixture flows into the nozzle by a suction, which eliminates the need of applying pressure, thus consequently making the apparatus simple.

Preferably, the nozzle can be formed of the throat area 4 and the outlet section 6 configured in such a way that the gas flowed in from the convergence inlet section 2 converges the flow of the gas/powder mixture sprayed from the spray hole 12 of the spray tube to reach the speed of sound, and then the flow is diverged (or expanded) again. Like this, the flowing speed of the gas/powder can be increased to supersonic sound or 300-1,200 m/s, having the effect of increasing the speed of the powder at the outlet end point 8, the ending edge of the outlet section 6.

Figure 12:
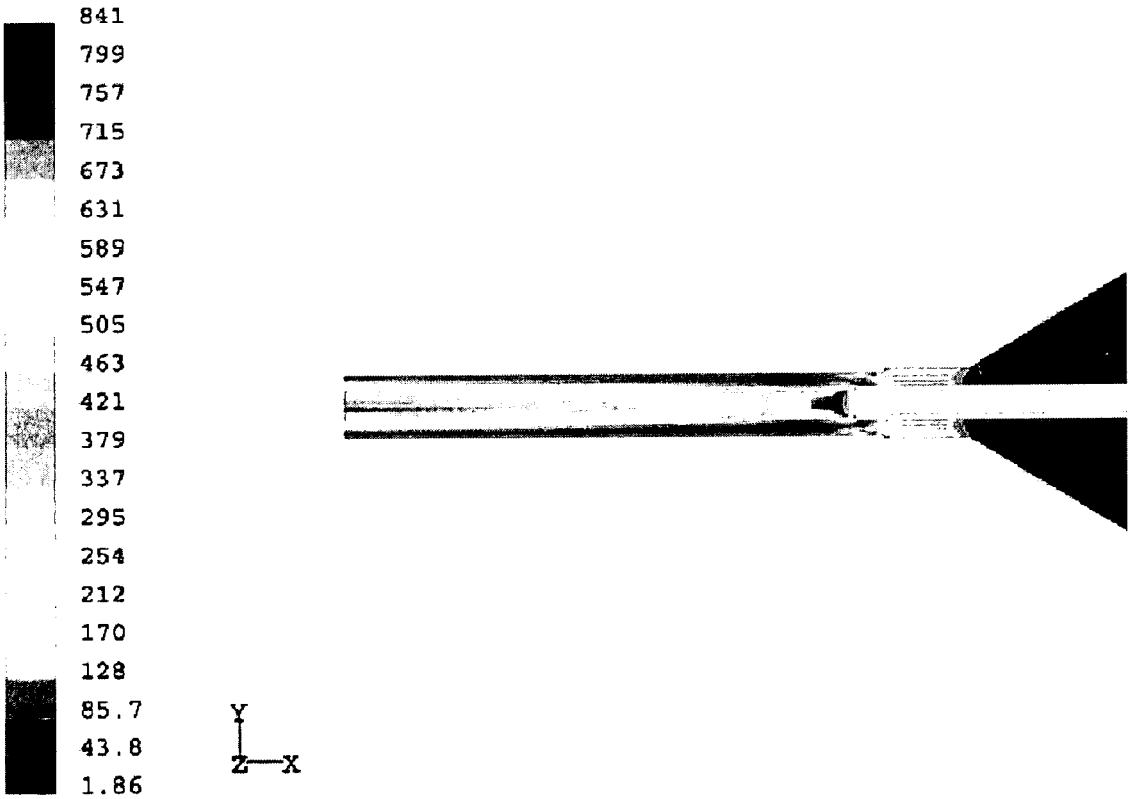
FIG. 12 is a result of a numerical analysis showing rheological characteristics of a nozzle for cold spray in an embodiment of the invention depicted in FIG. 11 (unit: m/s)
Figure 13:
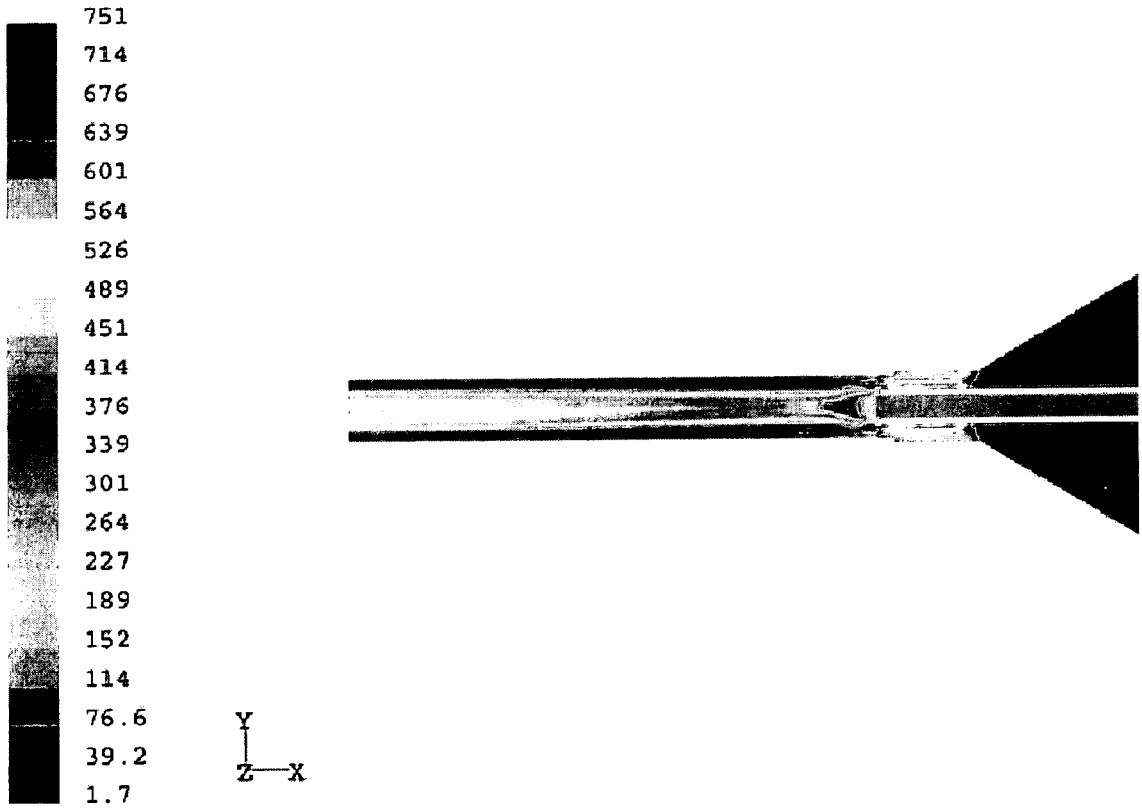
FIG. 13 is a result of a numerical analysis showing rheological characteristics of a nozzle for cold spray in an embodiment of the invention depicted in FIG. 11, when changing the location of the spray hole of a spray tube (unit: m/s)

That is, as illustrated in FIGS. 12 to 13, the carrier gas passing the throat area 4 is accelerated and reaches the speed of sound by the convergence inlet section 2, and acceleration to supersonic speed can be observed thereafter because the cross-sectional area at the outlet section 6 is increased, being a divergence area. In addition, the carrier gas contracts the flow of the gas/powder mixture coming out from the spray tube 20 as a result of expansion, thereby converging the flow sprayed from the spray hole 12 of the spray tube 20. In case when the convergence is sufficient to accelerate the speed of the flow sprayed from the spray hole 12 to supersonic sound, the flow is accelerated to the speed of sound, and the flow sprayed to the spray hole 12 is accelerated to the speed of sound through the diverging at the latter part of the outlet section where the contraction influence of the carrier gas is decreased, so that all the flow sprayed from the nozzle is accelerated to the speed of sound and the coating is accomplished with high collision speed. That is, the carrier gas that flows into the convergence inlet 2 undergoes the processes of general acceleration (convergence)–>speed of sound at the throat area–>supersonic acceleration (divergence) according to the real external configuration of the nozzle, and the gas/powder mixture sprayed from spray tube 20 attains high speed through the processes of general acceleration (convergence by flow)–>forming throat area by flow–>supersonic acceleration (according to the release of the flow influence) by the divergence flow of the carrier gas.

This can be clearly understood by observing the FIGS. 12 and 13. The flow from the spray tube 20 decreases in speed at first when it comes out from the tube, but is pushed inside, contracted, and converged by the flow of the vicinity, so the speed is increased to the speed of sound, and thereafter expanded again and accelerated to supersonic speed, which can be absolutely observed through the FIGS.

Figure 11:
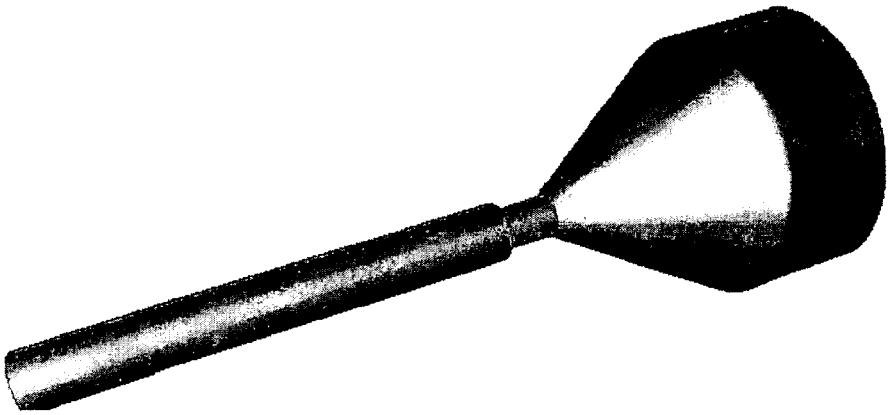
FIG. 11 is a perspective view showing a flow field model for numerical analysis of rheological characteristics of a nozzle for cold spray in an embodiment of the present invention.

In addition, the configuration of the outlet section 6 is not restricted if the speed of the powder is maintained 300-1,200 m/s, and configured diversely like a expanding (or diverging) form shown in FIG. 3 or a linear type shown in FIGS. 1 and 2. A desirable detailed example which induces the occurrence of the acceleration mechanism, as illustrated in FIGS. 1 and 2, is configured such that the outlet section 6 is configured in the form of a linear type with a wider cross-sectional area of the hollow section than the cross-sectional area of the hollow section of the throat area 4. More preferably, the nozzle for cold spray of the invention can be formed such that the throat area 4 and the outlet section 6 is configured in such a way that the gas flowed in from the convergence inlet section 2 converges the flow of the gas and powder mixture sprayed from the spray hole 12 of the spray tube to reach the speed of sound, and then the flow is diverged again. The configuration like this can be obtained through the illustrations of FIGS. 12 and 13, the results of modeling the flow field in forms of FIG. 11 and analyzing numerically using Fluent, a CFD analysis code for computerized flow analysis.

Furthermore, in a nozzle for cold spray of the present invention, the throat area 4, an area of minimum inner diameter of the nozzle, can be configured in forms of fixed length with the same cross-sectional area. An embodiment is illustrated in FIGS. 2 and 3, and, as depicted in FIG. 2, the spray hole 12 of the spray tube can be located inside the throat area, at the throat area, at the end of the throat area, or inside the outlet section, and can be moved to the desired location during, before, or after the process, as required.

Accordingly, as required, the spray tube 20 can be configured so as to move along the axis of the nozzle in order to change the location of the spray hole 12 inside the throat area or outlet section. Like this, clogging and vapor deposition by the coating inside the throat area 4 and outlet section 6 can be controlled, or adjustment in the direction to lower the abrasion is possible, and the final speed of the flow at the outlet end point can be controlled as shown in FIGS. 12 and 13. That is, in FIGS. 12 and 13, according to the change of the projection degree of the spray hole 12 (the length from the end of the throat area to the spray hole toward the outlet section), the big variance in the speed of the powder at the outlet end point 8 is observed. Like this, according to the kind of powder and the mixture ratio, appropriate speed control can be obtained simply by changing the location of the spray hole 12 of the spray tube, thereby simplifying the control.

In addition, the publicized diverse configuration can be applied to the cross-sectional areas of the hollow sections of the convergence inlet section 2, throat area 4, and spray tube 20 and the cross-sectional area of the hollow section of the outlet section 6, in accordance with the requirement of the process or the configuration to be coated. Preferably, the cross section of the hollow section of the convergence inlet section, throat area, or spray tube is circular, and the cross section of the hollow section of the outlet section is desirable to be configured in a circular, square, or rectangular shape for maintenance and stability of the flow field.

A detailed embodiment of the nozzle for cold spray of the invention can be obtained as followings. The outlet section is formed in a linear type with wider cross-sectional area of the hollow section than that of the throat area. When the total cross-sectional area of the inlet end point of the convergence inlet section is 900, the cross-sectional area of the flow channel, between the inside of the nozzle and the outside of the spray tube in the throat area, is configured in a ratio between 9 and 25, and the cross-sectional area of the hollow section of the spray tube is between 0.25 and 8, and the cross-sectional area of the outlet section is between 45 and 100. The convergence inlet section is configured as a convergence nozzle, which boosts the speed of the flow of the input gas that flows into the convergence inlet section to reach the speed of sound at the throat area.

Another detailed desirable embodiment can be configured as follows. The inner diameter of the throat area is 5 mm; the inner diameter of the outlet section is 7 mm; the outer diameter of the spray tube is 4.5 to 3.5 mm; and the inner diameter of the spray tube is 3 to 1.5 mm. The spray hole of the spray tube is located at 0 to 5 mm away from the outlet end point of the throat area toward the outlet section. More preferably, the outer diameter of the spray tube is 4 mm and the inner diameter can be 2 mm. In addition, spray tube can be configured such that the location of the spray hole can be changed along the axis of nozzle in the throat area or the outlet section and the location is 0 to 5 mm away from the outlet end point of the throat area toward the outlet section.

In this way, the flow in the nozzle prevents occurrence of back pressure, the pressure applied inside the spray tube, and obtains high speed flow, thereby accomplishing smooth spray.

In addition, the nozzle for cold spray of the invention can be configured so that the nozzle 10 further includes a buffer chamber 30, which expands from the end point of the throat area 4 or a certain point 22 in the outlet section 6 as a starting point to have a wider cross-sectional area of the hollow section than the cross-sectional area of the hollow section of the starting point 22 and then converges again, to form a fixed volume in the form of a connection 24 to the inner side of the outlet section 6, along with the configuration which is described above. At this time, the end point spray hole of the spray tube can be placed in the throat area, in the buffer chamber or in the outlet section, which come next to the throat area.

FIGS. 4 to 7 illustrate a detailed embodiment, in which the convergence inlet section 2 is so configured that the carrier gas reaches the speed of sound at the throat area 4, all the other part except the spray tube 20 being filled with only gas. Accordingly, the speed of the carrier gas at the throat area 4 comes up to the speed of sound, and the carrier gas passes the outlet section 6 where the flow is diverged and accelerated to 300-1,200 m/s. Together with the carrier gas, the gas/powder mixture supplied through the spray tube 20 is sprayed inside the throat area 4, the buffer chamber 30 or the outlet section 6 next to the throat area, therefore clogging due to coating or abrasion as a result of collision at the throat area 4 which is the smallest area is not occurred. That is, in addition, the nozzle section 10 includes a buffer chamber 30 which expands from the end point of the throat area 4 or a certain point 22 in the outlet section as a starting point to have a wider cross-sectional area of the hollow section than the cross-sectional area of the hollow section of the starting point 22 and then converges again, to form a fixed volume in the form of a connection 24 to the inner side of the outlet section 6. With the buffer chamber 30, the interaction between the flow accelerated to the supersonic speed and the inside of the nozzle 10 can be prevented fundamentally.

In addition, as the gas being sprayed in high speed areas, the pressure of the areas is lowered relatively, so the gas/powder mixture flows into the nozzle by a suction, which eliminates the need of applying pressure, thus consequently making the apparatus simple.

Preferably, the nozzle can be formed of the throat area 4 and the outlet section 6 configured in such a way that the gas flowed in from the convergence inlet section 2 converges the flow of the gas/powder mixture sprayed from the spray hole 12 of the spray tube to reach the speed of sound, and then the flow is diverged again. Like this, the flowing speed of the gas/powder can be increased to supersonic sound or 300-1,200 m/s, having the effect of increasing the speed of the powder at the outlet end point 8, the ending edge of the outlet section 6.

Figure 15:
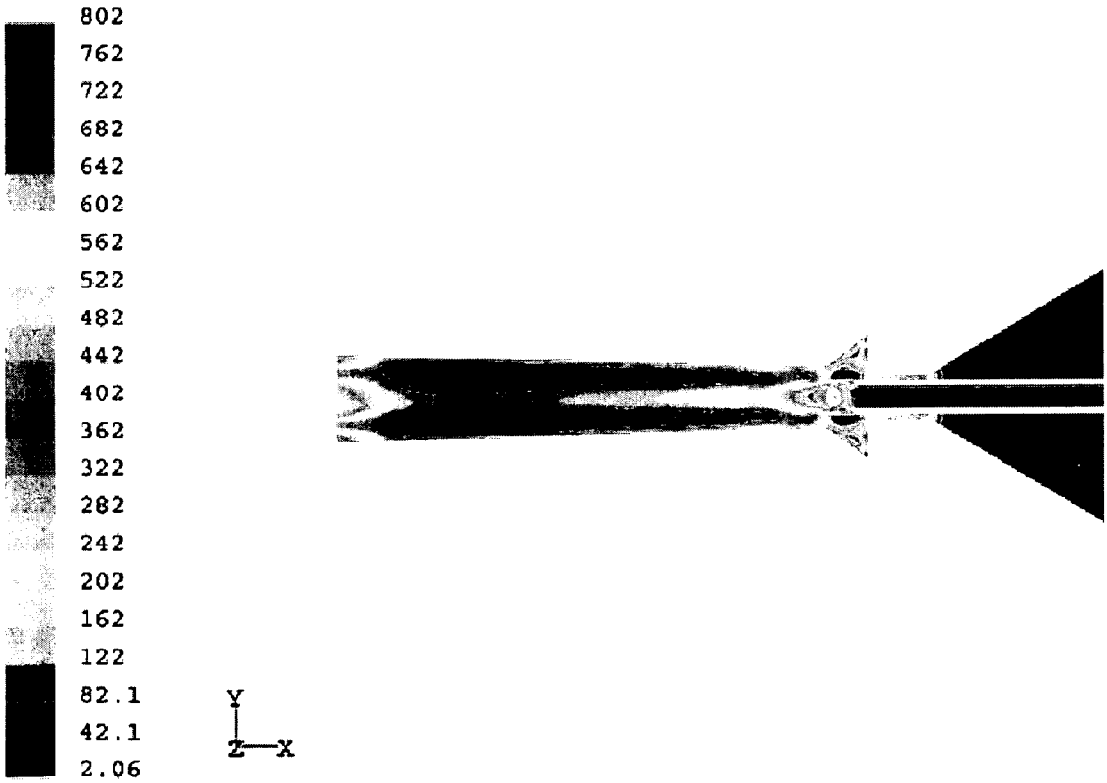
FIG. 15 is a result of a numerical analysis showing rheological characteristics of a nozzle for cold spray in an embodiment of the invention depicted in FIG. 14 (unit: m/s)
Figure 16:
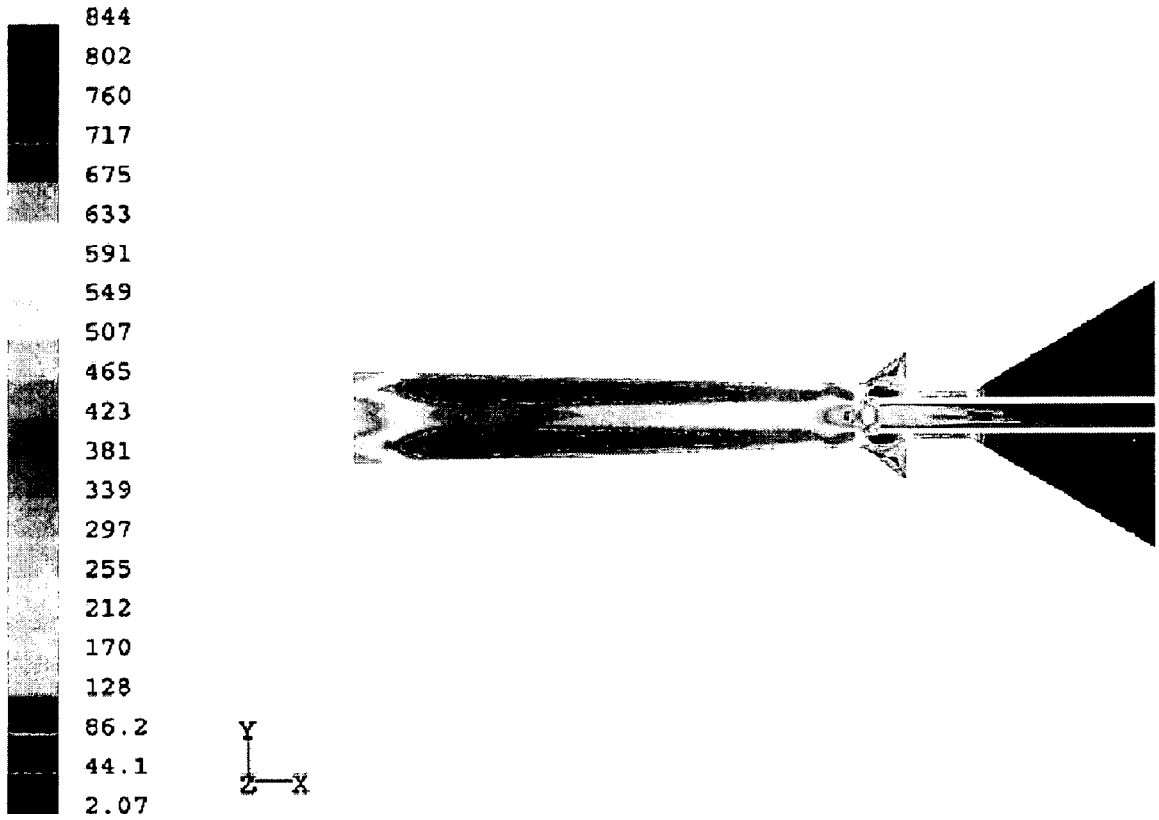
FIG. 16 is a result of a numerical analysis showing rheological characteristics of a nozzle for cold spray in an embodiment of the invention depicted in FIG. 14, when changing the location of the spray hole of a spray tube (unit: m/s)

That is, as illustrated in FIGS. 15 to 16 in the case with the buffer chamber similar with the system without the buffer chamber, the carrier gas passing the throat area 4 is accelerated and reaches the speed of sound by the convergence inlet section 2, and acceleration to supersonic speed can be observed thereafter because the cross-sectional area at the outlet section 6 is increased, being a divergence area similarly with the mechanism explained in the system without the buffer chamber. In addition, the carrier gas contracts the flow of the gas/powder mixture coming out from the spray tube 20 as a result of expansion, thereby converging the flow sprayed from the spray hole 12 of the spray tube 20. In case when the convergence is sufficient to accelerate the speed of the flow sprayed from the spray hole 12 to supersonic sound, the flow is accelerated to the speed of sound, and the flow sprayed to the spray hole 12 is accelerated to the speed of sound through the diverging at the latter part of the outlet section where the contraction influence of the carrier gas is decreased, so that all the flow sprayed from the nozzle is accelerated to the speed of sound and the coating is accomplished with high collision speed.

This can be clearly understood by observing the FIGS. 15 and 16. The flow from the spray tube 20 decreases in speed at first when it comes out from the tube, but is pushed inside, contracted, and converged by the flow of the vicinity, so the speed is increased to the speed of sound, and thereafter expanded again and accelerated to supersonic speed, which can be absolutely observed through the FIGS.

Figure 4:
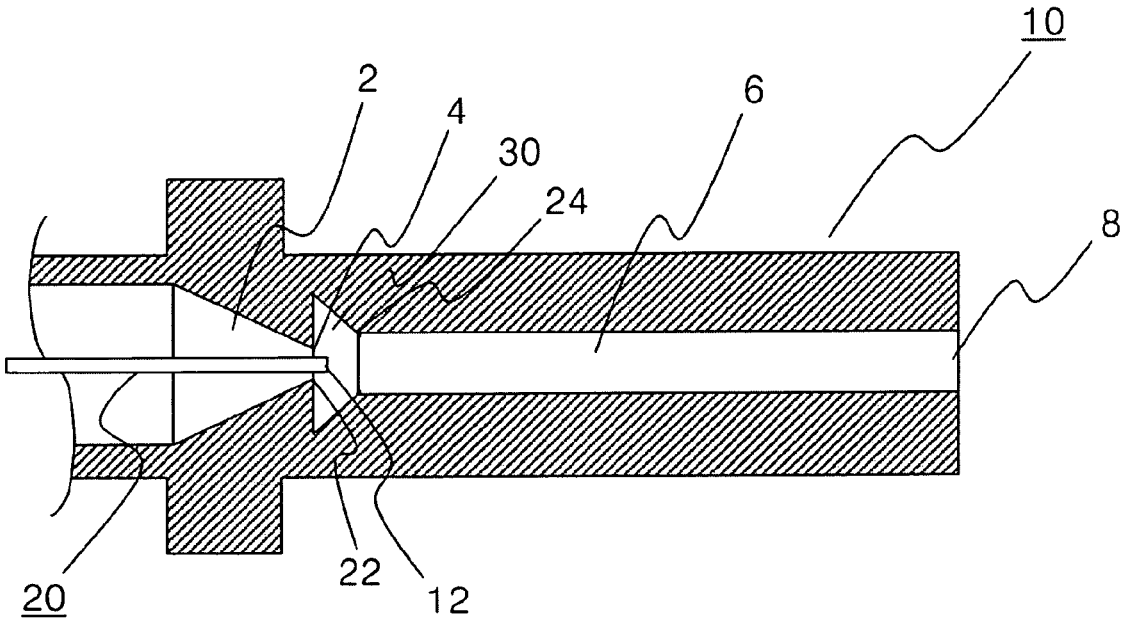
FIGS. 4 to 7 are cross-sectional views showing nozzles for cold spray with buffer chambers.
Figure 5:
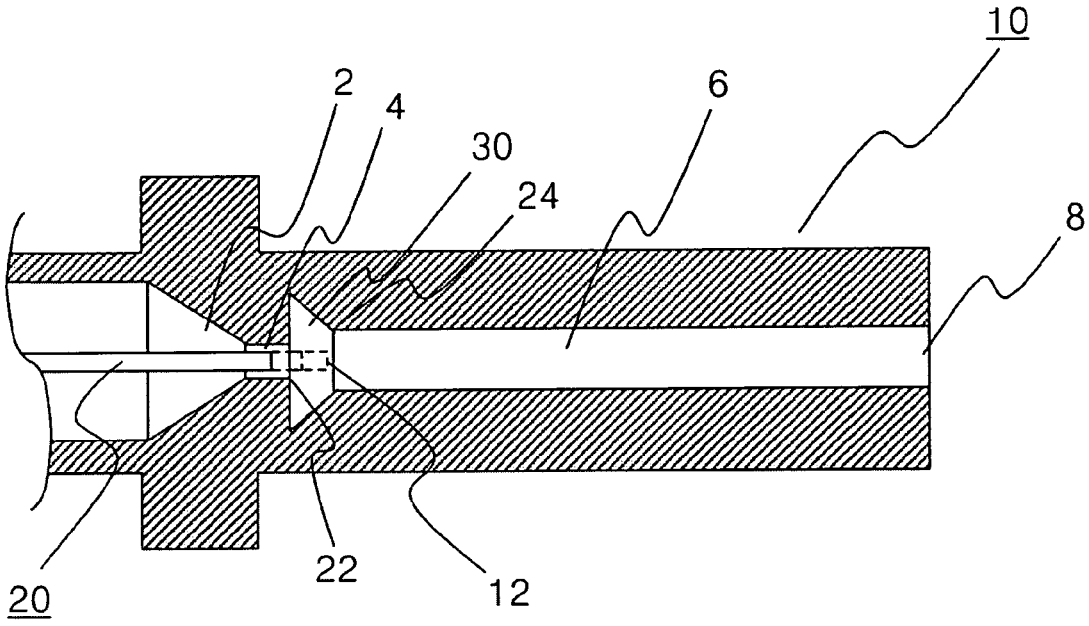
Figure 6:
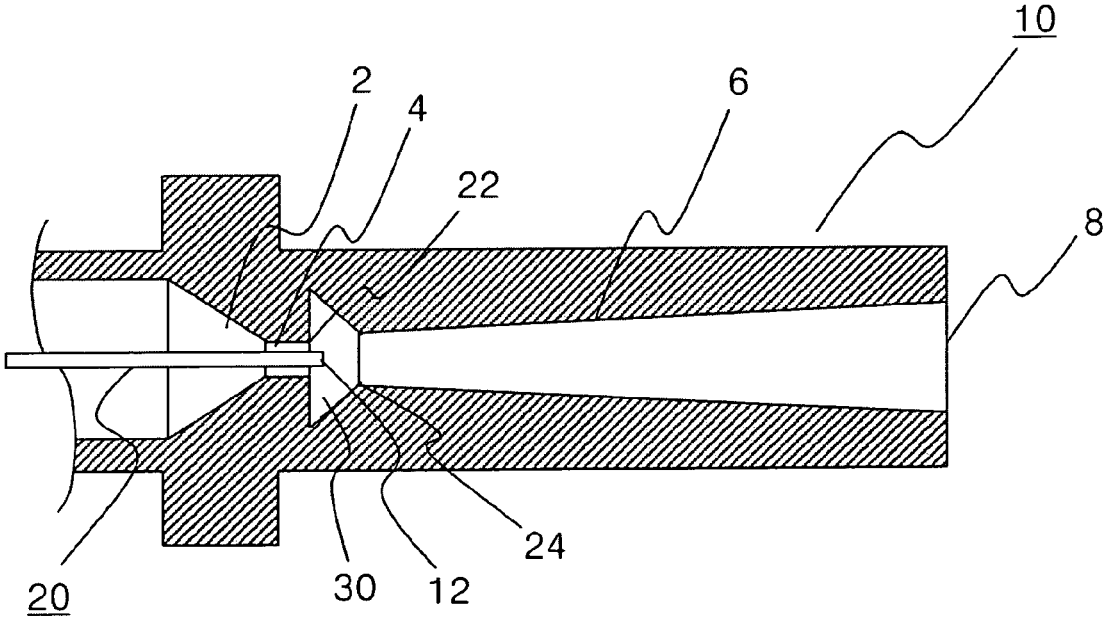
Figure 7:
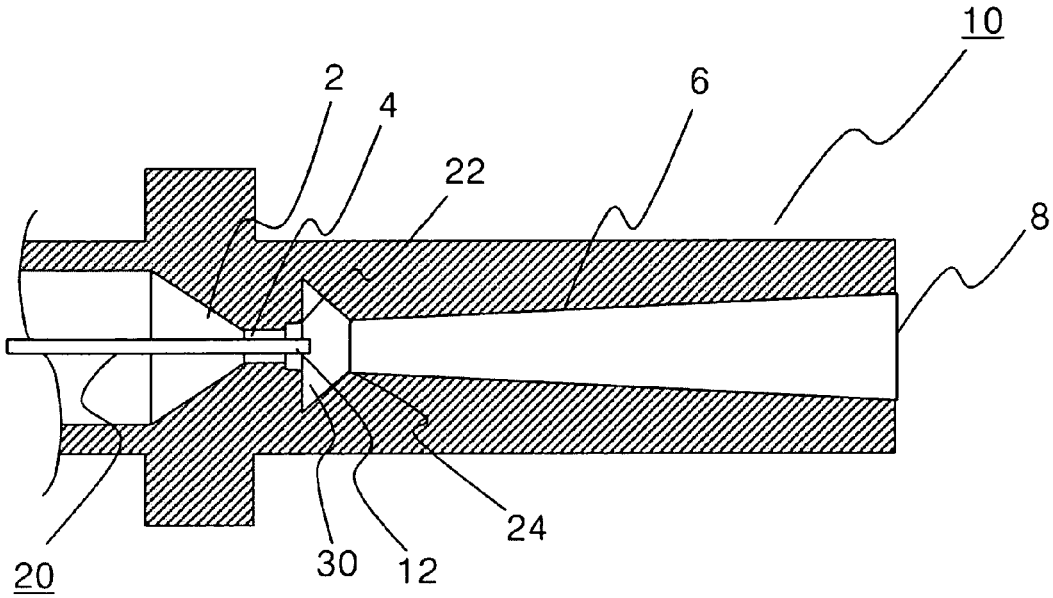
Figure 8:
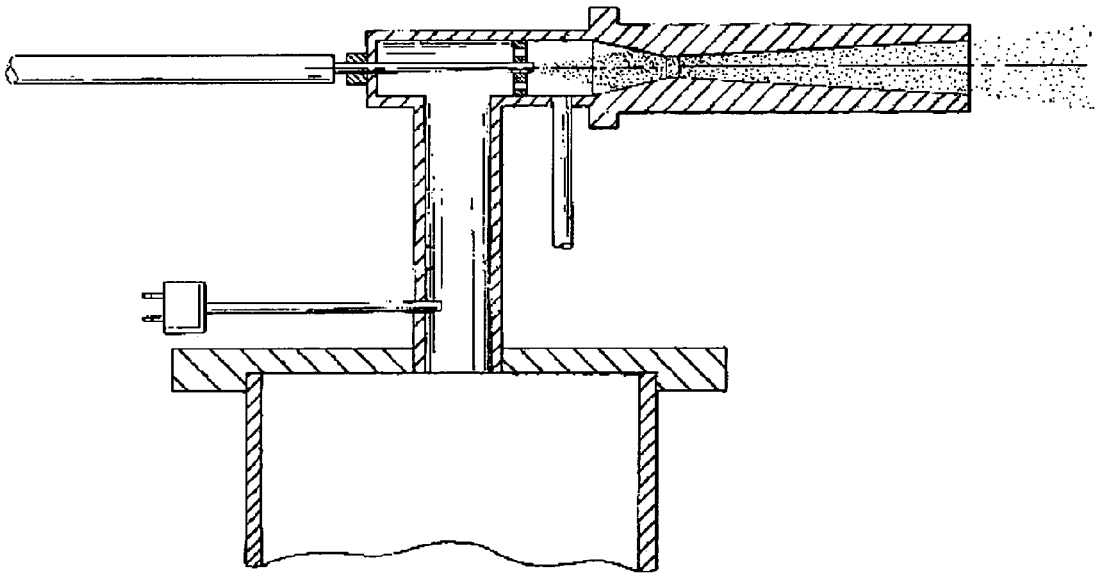
FIG. 8 is a schematic view showing a nozzle and a system thereof for cold spray in a conventional way.
Figure 9:
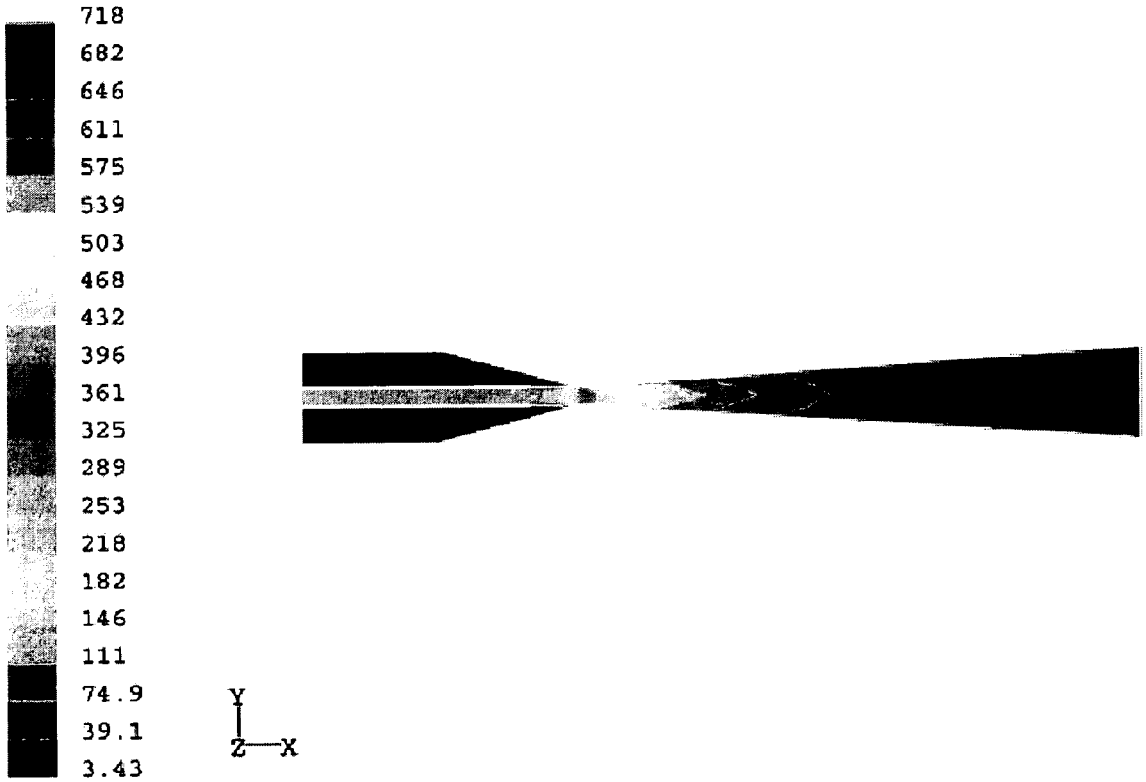
FIG. 9 is a result of a numerical analysis showing rheological characteristics of a nozzle for cold spray in a conventional way depicted in FIG. 8 (unit: m/s)
Figure 10:
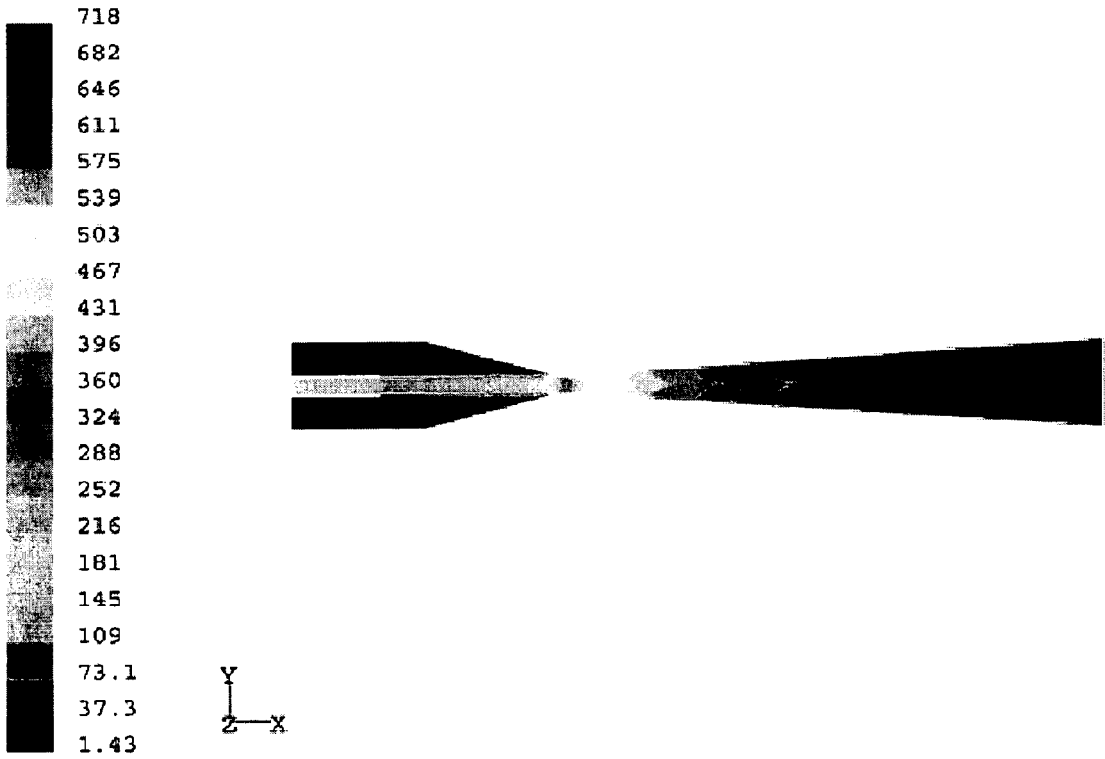
FIG. 10 is a result of a numerical analysis showing rheological characteristics of a nozzle for cold spray in a conventional way depicted in FIG. 8, when changing the location of the spray hole of a spray tube (unit: m/s)

In addition, the configuration of the outlet section 6 is not restricted if the speed of the powder is maintained 300-1,200 m/s, and configured diversely like a diverging form shown in FIGS. 6 and 7 or a linear type shown in FIGS. 4 and 5. A desirable detailed example which induces the occurrence of the acceleration mechanism, as illustrated in FIGS. 4 and 5, is configured such that the outlet section 6 is configured in the form of a linear type with a wider cross-sectional area of the hollow section than the cross-sectional area of the hollow section of the throat area 4. More preferably, the nozzle for cold spray of the invention can be formed such that the throat area 4 and the outlet section 6 is configured in such a way that the gas flowed in from the convergence inlet section 2 converges the flow of the gas and powder mixture sprayed from the spray hole 12 of the spray tube to reach the speed of sound, and then the flow is expanded (or diverged) again. Furthermore, as a desirable detailed example of minimizing the interaction between the inner side of the nozzle 10 and the powder, illustrated in FIGS. 6 and 7, the outlet section 6 can be configured in the form of a divergence type with a wider cross-sectional area of the hollow section than the cross-sectional area of the hollow section of the throat area 4. More preferably, the nozzle for spray of the invention can be formed to have a configuration of the throat area 4 and outlet section 6, a configuration in which the gas flows in from the convergence inlet section 2 converges the flow of the gas and powder mixture, sprayed from the spray hole 12 of the spray tube, to reach supersonic speed and expands the flow again.

Figure 14:
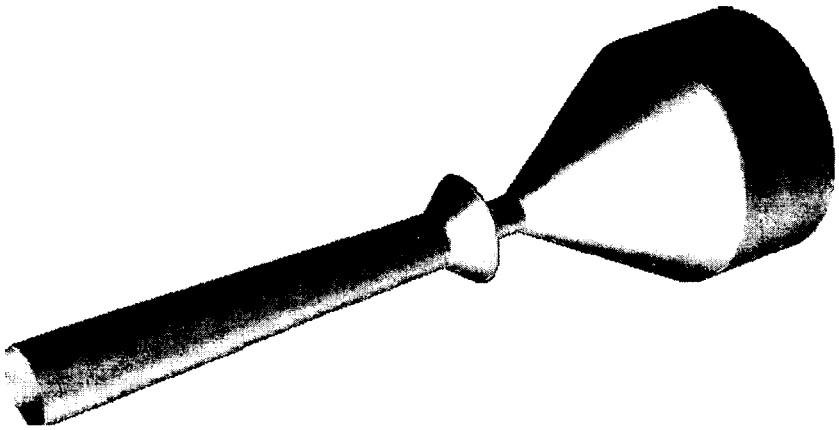
FIG. 14 is a perspective view showing a flow field model for numerical analysis of rheological characteristics of a nozzle for cold spray in an embodiment of the present invention having a buffer chamber.

The configuration like this can be obtained through the illustrations of FIGS. 15 and 16, the results of modeling the flow field in forms of FIG. 14 and analyzing numerically using Fluent, a CFD analysis code for computerized flow analysis.

Furthermore, in a nozzle for cold spray of the invention, the throat area 4, an area of minimum inner diameter of the nozzle, can be configured in forms of fixed length with the same cross-sectional area. An embodiment is illustrated in FIGS. 5 to 7, and, as depicted in FIG. 5, the spray hole 12 of the spray tube can be located inside the throat area, at the throat area, at the end of the throat area, inside the buffer chamber or inside the outlet section, and can be moved to the desired location during, before, or after the process, as required.

Accordingly, as required, the spray tube 20 can be configured so as to move along the axis of the nozzle in order to change the location of the spray hole 12 inside the throat area, buffer chamber or outlet section as depicted in FIG. 5 as an embodiment. Like this, clogging and vapor deposition by the coating inside the throat area 4 and outlet section 6 can be controlled, or adjustment in the direction to lower the abrasion is possible, and the final speed of the flow at the outlet end point can be controlled as shown in FIGS. 15 and 16. That is, in FIGS. 15 and 16, according to the change of the projection degree of the spray hole 12 (the length from the end of the throat area to the spray hole toward the outlet section), the big variance in the speed of the powder at the outlet end point 8 is observed. Like this, according to the kind of powder and the mixture ratio, appropriate speed control can be obtained simply by changing the location of the spray hole 12 of the spray tube, thereby simplifying the control.

In addition, the publicized diverse configuration can be applied to the cross-sectional areas of the hollow sections of the convergence inlet section 2, throat area 4, and spray tube 20 and the cross-sectional area of the hollow section of the outlet section 6, in accordance with the requirement of the process or the configuration to be coated. Preferably, the cross sections of the hollow section of the convergence inlet section, throat area, buffer chamber and spray tube are circular, and the cross section of the hollow section of the outlet section is desirable to be configured in a circular, square, or rectangular shape for maintenance and stability of the flow field.

In addition, in order to prevent the coating and abrasion of the inside of the nozzle by the collision to the inside of the nozzle of the mixture, a mixture of the gas/powder mixture sprayed from the spray tube and the carrier gas, expanding a portion of the space inside the nozzle is useful, so that, in order for this purpose, the buffer chamber described above is provided inside the nozzle section as described above, and, preferably, the outlet section is formed in a diverge type.

In addition, as illustrated in FIGS. 4 to 7, the buffer chamber 30 is configured such that, from the certain point as a starting point 22, the inner diameter increases vertically in a predetermined uniform width so as to have a wider cross-sectional area of the hollow section than the cross-sectional area of the hollow section of the starting point 22, and the inner diameter decreases in a fixed ratio thereafter, forming a connecting section 24 combined to the inside of the outlet section. The location of this buffer chamber can be configured from the end point of the throat area as depicted in FIGS. 4 to 6, or configured to be placed at a predetermined portion inside the outlet section as described in FIG. 7.

In addition, the above decrease of the sections which decreases in a predetermined ratio can be various types of linear, exponential, or parabolic decrease. Preferably, as illustrated in FIGS. 4 to 7, for the decrease of the inner diameter of the buffer chamber in a predetermined ratio, decreasing in the form of a straight line which is inclined at 30 to 60 degrees from the center axis of the nozzle is better in view of simplifying the production and minimizing the phenomena of clogging and abrasion.

A detailed embodiment of the nozzle for cold spray of the invention can be obtained as followings. The outlet section is formed in a diverge type (divergence type) with wider cross-sectional area of the hollow section than that of the throat area. When the total cross-sectional area of the inlet end point of the convergence inlet section is 900, the cross-sectional area of the flow channel, between the inside of the nozzle and the outside of the spray tube in the throat area, is configured in a ratio between 9 and 25, and the cross-sectional area of the hollow section of the spray tube is between 0.25 and 8, and the cross-sectional area of the outlet section is between 45 and 100. The convergence inlet section is configured as a convergence nozzle, which boosts the speed of the flow of the input gas that flows into the convergence inlet section to reach the speed of sound at the throat area.

Another detailed desirable embodiment can be configured as follows. The inner diameter of the throat area is 5 mm; the buffer chamber is configured from the end point in the direction of the throat area as a starting point, in which the inner diameter at the starting point is 14 mm and the inner diameter is decreased in the form of a straight line inclined at 30 to 60 degrees from the center axis of the nozzle, and is combined with the inside of the outlet section at the point where the inner diameter is 7 mm; in the outlet section, the distance from the end point of the throat area toward the outlet section to the end point of the outlet is 60 mm and the inner diameter of the end point of the outlet is 10 mm; the outer diameter is 4.5 to 3.5 mm, and the inner diameter of the spray tube is 3 to 1.5 mm, with the spray hole of the spray tube located within the buffer chamber.

In this way, the flow in the nozzle prevents occurrence of back pressure, the pressure applied inside the spray tube, reduces clogging and abrasion of the nozzle by minimizing the interaction between the powder sprayed from the spray tube and the inner surface of the nozzle, and obtains high speed flow, thereby accomplishing smooth spray.

In addition, the invention provides with a cold spray apparatus, which includes a cold spray nozzle of the invention in various configurations described above, a gas supplying device connected to the convergence inlet section of the nozzle, and a gas/powder mixture supplying device connected to the spray tube.

Figure 17:
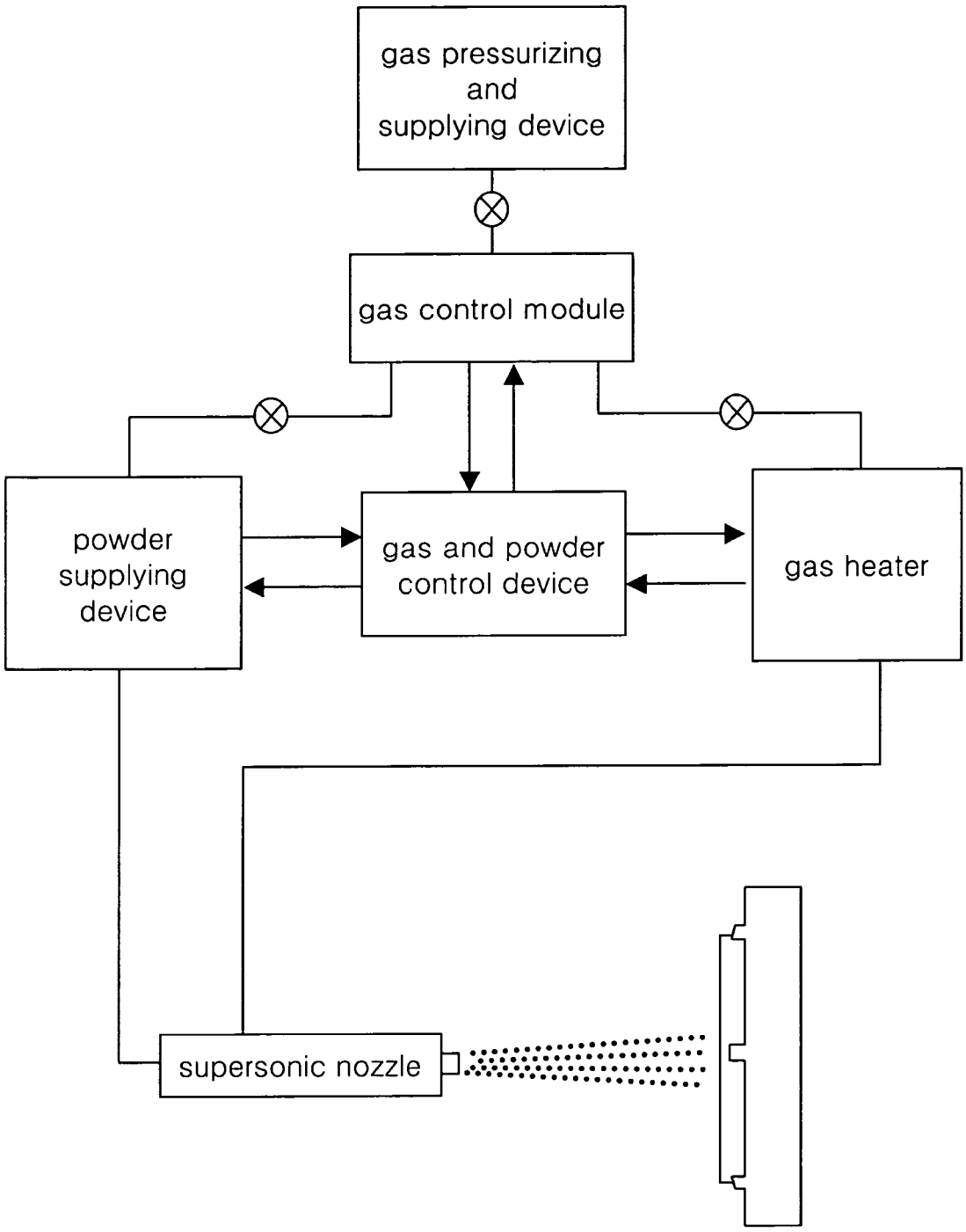
FIG. 17 is a schematic view showing a system of cold spray apparatus applying a nozzle for cold spray of the invention.

A detailed example is illustrated in FIG. 17, and can be applied to all the apparatuses to which a general publicized cold spray apparatus is applied. Only the pressure supplied to the spray tube is low, so that an additional pressurizing device may not be included in the input end point of the spray tube.

Furthermore, using a cold spray apparatus like this, a cold spray process can be made through a condition similar to the publicized cold spray process. That is, a cold spray method provided in the invention includes the steps of: accelerating the gas provided from the gas supply device to the speed of sound or supersonic speed with the cold spray apparatus; mixing the accelerated gas with a gas/powder mixture provided from the gas/powder mixture supply device; accelerating the powder to 300 to 1,200 m/s while maintaining the gas/powder mixture in a sufficiently low temperature; and spraying and coating the accelerated powder on the surface of the object to be coated.

In the above process, all the similar conditions of the publicized cold spray can be applied as the condition of the process. Since the spray is accomplished by suction even though the pressure supplied to the spray tube is low, the pressure supplied can be maintained low, and it goes without saying that the pressure supplied can be controlled high if necessary.

In addition, the gas/powder mixture can have various ranges from 1 to 99 volume percent ratio of the powder in the mixture. Various materials which can be used as the powder are metal, alloy, a mixture of metal or alloy, an organic matter, an inorganic matter, a mixture of an organic or inorganic matter, or a mixture of all these matters, and, according to the coating requirement characteristics, a single layer or multi layer coating can be accomplished with various combinations of those materials.

Besides, the present invention provides a coating material coated by the cold spray method. Various materials such as the metal, alloy, a mixture of metal or alloy, an organic matter, an inorganic matter, a mixture of an organic or inorganic matter, or a mixture of all these matters can be used as coating objects, objects to be coated, and, according to the coating objects requirement characteristics, various forms of combinations of those materials are possible.

According to the nozzle for cold spray for the invention and a cold spray apparatus using the same, clogging phenomenon of the nozzle is minimized when coating with powder of soft material, and abrasion of the nozzle is prevented when coating with powder of very hard material, thereby making it easy to apply to mass production since the nozzle can be used for a long time without clogging or modification in configuration of a nozzle.

In addition, since high quality coating is allowed for a long time continuously, maintenance/repair associated problems and operating costs are reduced, thereby reducing manufacturing costs.

Besides, without controlling the flow rate of gas supply, modifications of processes are easy since the speed of powder sprayed from the outlet section of the nozzle can be controlled simply by displacing the spray tube, thereby having diverse means for process control.

Also, since a pressurizing device is not included in the gas/powder supplying device, a coating apparatus is configured with low costs and thus initial costs are reduced, thereby having economical effects.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A nozzle for cold spray comprising:

a hollow-type nozzle section including a convergence inlet section having a converging cross-section area, a throat area connected to a converging end point of the convergence inlet section, a buffer chamber, which expands out in a radial direction at an end point of the throat area to form a vacant volume, and a divergence outlet section connected to an end point of the buffer chamber; and a spray tube having an end point spray hole, the spray tube being disposed inside the hollow-type nozzle in such a manner that the end point spay hole of the spray tube is placed at the throat area, in the buffer chamber, or in the divergence outlet section, wherein the divergence outlet section is configured in the form of a linear type having a cross-sectional area wider than that of the throat area;

wherein a gas flows in the hollow-type nozzle, and a mixture of gas and powder mixture flows in the spray tube; and wherein the powder reaches at a speed of 300-1,200 m/s at an exit of the divergence outlet section.

2. A nozzle for cold spray according to claim 1, wherein the throat area and the divergence outlet section are configured in such a way that the gas flown in from the convergence inlet section converges flow of the mixture of gas and powder sprayed from the spray hole of the spray tube to reach a speed of sound, and then to diverge the flow of the mixture of gas and powder.

3. A nozzle for cold spray according to claim 1, wherein the throat area and the divergence outlet section is configured in such a way that the gas flown in from the convergence inlet section converges flow of the mixture of gas and powder sprayed from the spray hole of the spray tube to reach a speed of sound, and then to diverge the flow of the mixture of gas and powder.

4. A nozzle for cold spray according to claim 1, wherein the throat area forms a minimum inner diameter of the nozzle, and has a predetermined length having a same cross-sectional area.

5. A nozzle for cold spray according to claim 1, wherein the spray tube is movable along a longitudinal axis of the nozzle in order to change the location of the spray hole inside the throat area, the buffer chamber, or the divergence outlet section.

6. A nozzle for cold spray according to claim 1, wherein the convergence inlet section, the throat area, and the spray tube has a circular cross-section, and the divergence outlet section has a circular, square, or rectangular cross-section.

* * * * *